United States Patent [19]

Stoppazzini

[11] Patent Number: 4,571,955

[45] Date of Patent: Feb. 25, 1986

[54] AUTOMATIC STRAIGHT KNITTING MACHINE

[75] Inventor: Benito Stoppazzini, Sala Bolognese, Italy

[73] Assignee: E.M.M. Emiliana Macchine Maglierie s.r.l., Bologna, Italy

[21] Appl. No.: 709,709

[22] Filed: Mar. 8, 1985

[30] Foreign Application Priority Data

Mar. 19, 1984 [IT] Italy ..... 3386 A/84
Jun. 29, 1984 [IT] Italy ..... 3506 A/84

[51] Int. Cl.[4] ..... D04B 7/00
[52] U.S. Cl. ..... 66/75.1; 66/7
[58] Field of Search ..... 66/78, 75.1, 75.2

[56] References Cited

U.S. PATENT DOCUMENTS

| | | | |
|---|---|---|---|
| 3,972,206 | 8/1976 | Mureso. | |
| 4,222,247 | 9/1980 | Hashimoto et al. | 66/75.1 |
| 4,287,727 | 9/1981 | Otoshi | 66/75.2 |
| 4,294,085 | 10/1981 | Trautner | 66/75.1 |
| 4,490,994 | 1/1985 | Essig | 66/75.1 |

FOREIGN PATENT DOCUMENTS

| | | |
|---|---|---|
| 2226495 | 11/1974 | France. |
| 2038887 | 7/1980 | United Kingdom. |
| 2120687 | 12/1983 | United Kingdom. |

*Primary Examiner*—Ronald Feldbaum

*Attorney, Agent, or Firm*—Stevens, Davis, Miller & Mosher

[57] ABSTRACT

Inserted is each slit of the needle bed of this machine is a needle underneath which is placed a blade element that is provided with three butts, namely a first butt at the top, a second butt below, and a third butt at the bottom. The said third and last butt is carried by a tail-piece able to oscillate or undergo flexure, in contrast with elastic means, inside the corresponding slit.

The selection of a blade element is defined by the operation of a selector element, integral with the carriage, whereby the first butt is intercepted causing the blade element to be raised from the neutral position.

Through action exerted on the third butt by an operating cam, the blade element is raised further in cases when the selection operation is fully satisfactory; should this not be the case, as also when the blade element is in the neutral position, the cam acts as a guide for the said third butt in order to reach, or maintain, the said neutral position.

11 Claims, 10 Drawing Figures

Fig. 6
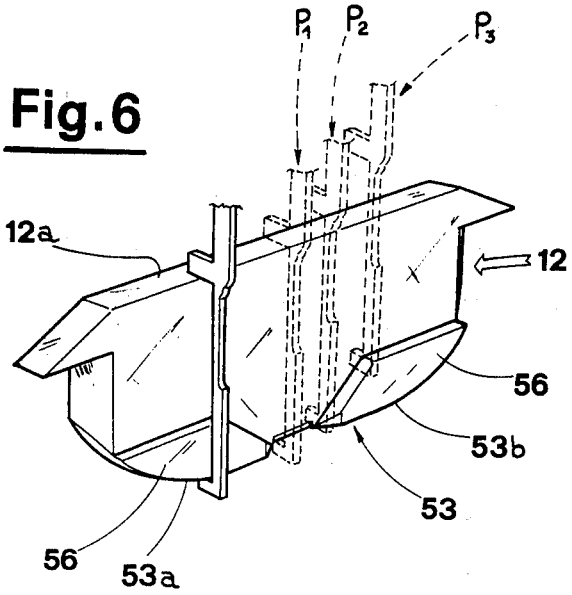
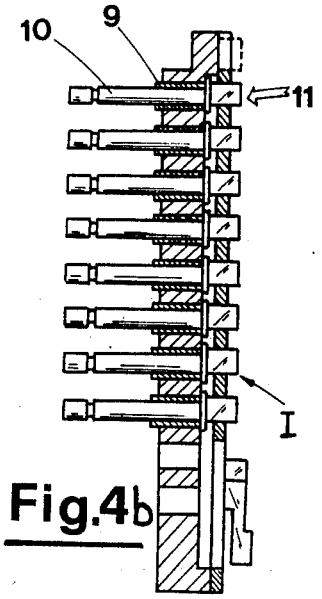
Fig. 4b
Fig. 7
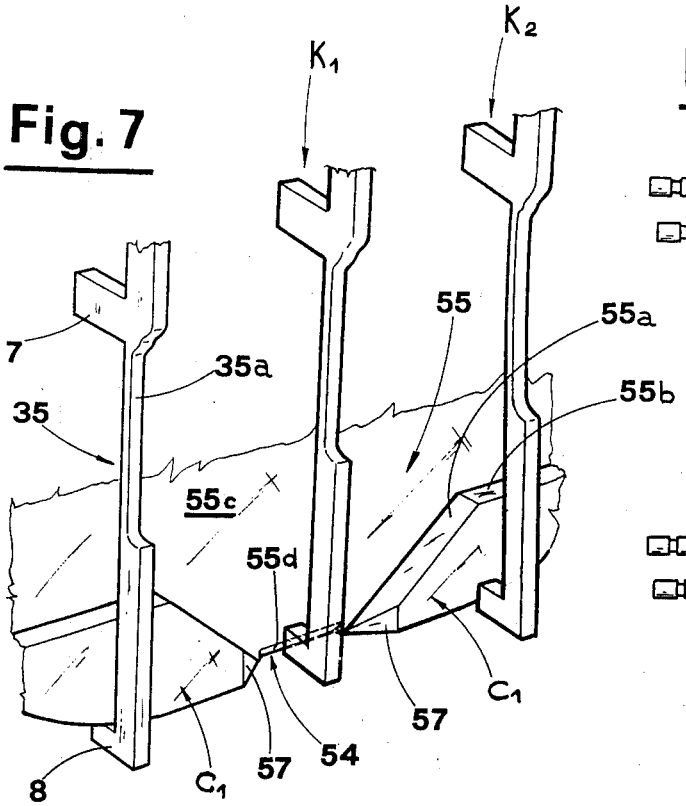
Fig. 5a
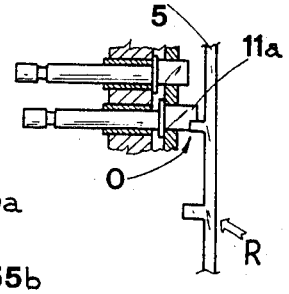
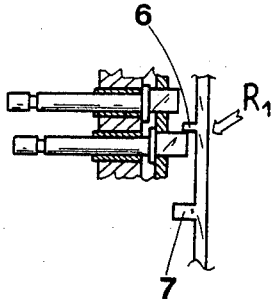
Fig. 5b

AUTOMATIC STRAIGHT KNITTING MACHINE

BACKGROUND OF THE INVENTION

The invention relates to an improved automatic straight knitting machine.

DESCRIPTION OF THE PRIOR ART

As is known, the needle beds of an automatic straight knitting machine are provided with slits that are equidistant and perpendicular to the direction in which the carriage moves. Provided in each slit, starting at the top and working downwards, there is, in the order stated, a needle, an intermediate blade element and a bottom blade element that is destined to carry the blade in operation (obviously with the synchronous movement of the intermediate blade element).

The bottom blade element is provided with a first butt and a second butt, the latter destined, in cooperation with a corresponding selector element with which the carriage is equipped, to select the appropriate blade element. The said selection is defined by a predetermined upward movement on the part of the blade element that is sufficient to position the first butt in the path of one or more fixed cams, integral with the carriage, which by intercepting the said first butt carry upwards the bottom blade element (and consequently the also the intermediate blade element) plus the corresponding needle, causing this to be set in action.

In each carriage, and for each needle bed, provision is made for one or more sets of selector elements, and in each of these the elements are perpendiculatly to the direction in which the carriage moves. Controlled for example by an electromagnet, each selection element is able to move between a non-operative position and an operative position, the latter bringing about the interception of the second butt of the corresponding bottom blade element. Obvious is the advisability of increasing the number of selector elements in each set since, with each working travel of the carriage, each said set is able to select an identical number of blade elements.

The foregoing necessitates the use of selector elements of a volume height-wise (that is to say, in the direction perpendicular to that in which the carriage moves) that is limited; in other words, such as to allow each element to be inserted between a pair of second butts belonging to two consecutive blade elements, in such a way that the said element intercepts the corresponding butt and not that of the following (or preceding) blade element. The said requirement leads necessarily to limiting the upward movement of the second blade element (if selected) and thus to very narrow tolerances, one with respect to the other, in the positioning of the blade elements, the selector elements and the fixed cams.

In the event of the selector element operating sluggishly on the corresponding butt, or intercepting this imperfectly, the upward movement of the blade element is below the preestablished value causing either non-interception of the first butt on the part of the fixed cam (the less disastrous hypothesis), whereby the corresponding needle is not carried into operation, or the breakage of the said first butt against the front end of the said cams.

SUMMARY OF THE INVENTION

The object of the invention is, therefore, to make available an improved automatic straight knitting machine whose conformation is such as to simplify the necessary sequence for carrying the needles into operation, and to do so in a way that is extremely functional, briefly timed, and exercises a notably positive effect on the operating speeds of the said machine, without any danger of the blade elements breaking.

The said object is achieved with the machine according to the invention, comprising, among other things, at least one flat longitudinal needle bed provided with transverse equidistantly made slits, in each of which is inserted, commencing at the top and working downwards, a needle with the corresponding blade element, the latter provided with at least two butts, namely a first butt and a second butt, that project from the front side of the needle bed, a carriage being connected to this, able to reciprocate longitudinally, in turn comprising: firstly, selector elements, symmetrical with respect to a transverse plane and movable between two positions, that is to say, a non-operative position and an operative position, the latter for intercepting the first butt of a corresponding blade element, with the consequent raising of this from a neutral position to a first intermediate position; secondly, means destined to raise the said blade element from the first intermediate position to a second intermediate position; thirdly, means for intercepting the said second butt in order, first of all, to raise the said blade element from the second intermediate position to a maximum elevated position, with the corresponding needle sent into operation, and then to lower the said blade element down to the said neutral position; the said machine being characterized by the fact that the said means for raising the said blade element from the first inter mediate position to the second intermediate position comprise, on each blade element, a third butt oriented in like fashion to the other butts, positioned beneath the second butt and connected thereto through a tailpiece restrained to elastic means such as to permit the said tailpiece to undergo oscillations over the transverse plane of the slit in which the said blade element is received; the said raising means also comprising an operating cam, integral with the carriage, that exerts an effect on the said third butt in order to uplift the corresponding blade element from the said first intermediate position to the said second intermediate position solely when the said blade element is in the said first position, or in order to guide the said third butt, and thus the corresponding blade element, into the said neutral position or into a position in between this and the first intermediate position.

BRIEF DESCRIPTION OF THE DRAWINGS

The characteristics of the machine according to the invention will become more apparent from the description of two preferred embodiments given hereinafter, with reference to the accompanying tables of drawings, in which:

FIGS. 4*a* and 4*b* show, diagrammatically, a view along the line I—I and along the line II—II in FIG. 2, respectively, with the operating cam depicted in FIG. 3;

FIGS. 5*a* and 5*b* show, diagrammatically, the commencement and end of the interception of a selector element against the first butt of the corresponding blade element;

FIG. 6 shows, in a perspective view, a second embodiment for the fixed operating cam;

FIG. 7 shows, again in a perspective view, an enlarged part of the cam depicted in FIG. 6, as well as certain positions the said cam obliges a blade element, not selected in an optimum way, to adopt.

DESCRIPTION OF THE PREFERRED EMBODIMENT

Figures 1, 1A, 2:
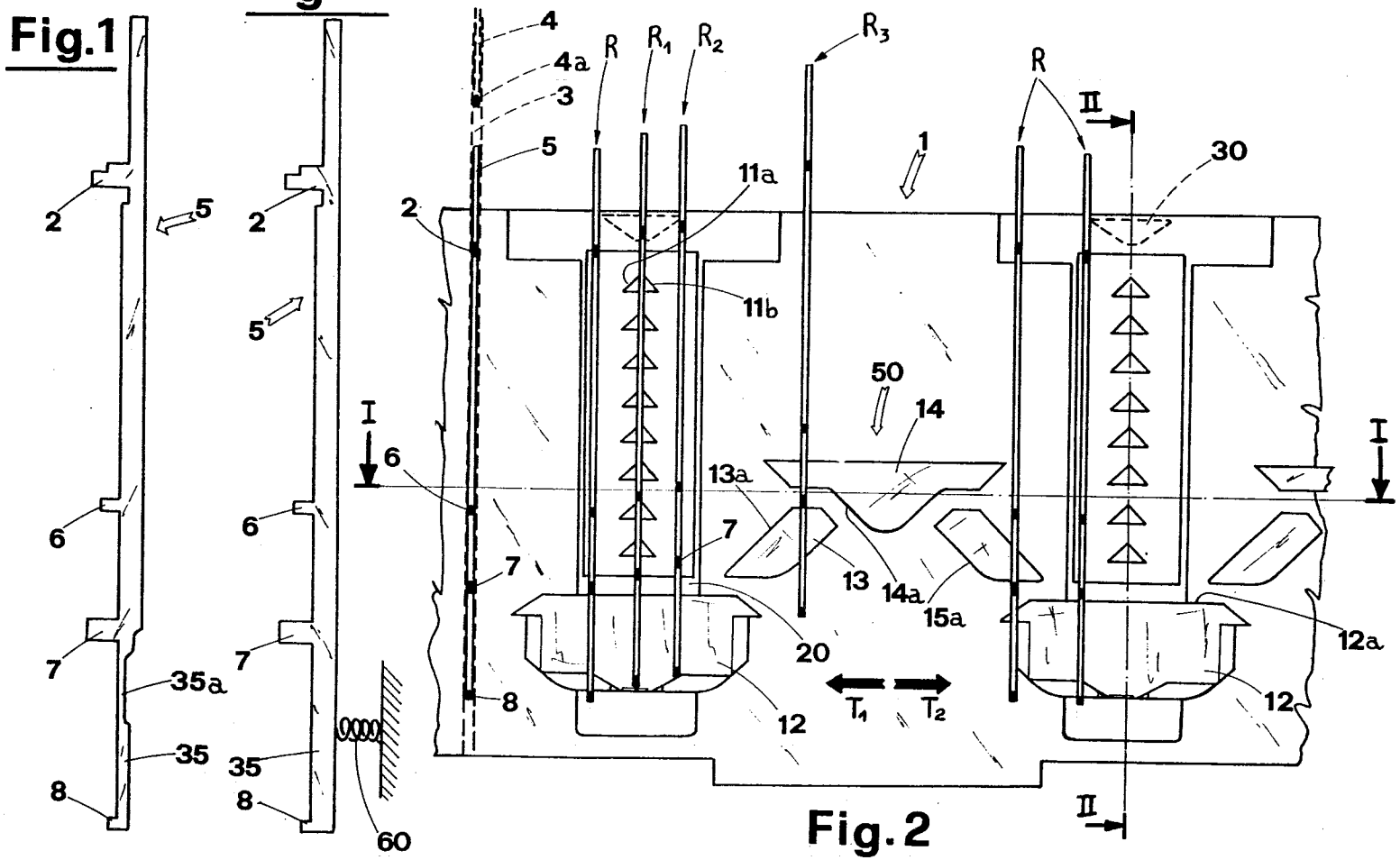
FIGS. 1 and 1*a* each show, in a lateral view, a blade element and the elastic means connected thereto.
FIG. 2 shows, diagrammatically in a front view, the carriage and the most significant positions adopted by a blade element selected by the said carriage.

With reference to FIGS. 1 to 5, shown at 1 a diagrammatic view is a carriage of an automatic straight knitting machine, that slides above a needle bed (not illustrated since of a known type) in which are provided slits 3 (one of which is shown with dashes) perpendicular to the direction in which the carriage moves (directions T1 and T2).

Freely inserted in each slit at the top is a blade element 4 (shown partially with dashes), the upper part of which is provided with a (non-illustrated) needle of a known type.

Below a butt 4*a* of the blade element 4, freely inserted in the said slit is a blade element 5 provided, commencing at the bottom and working upwards, with a butt 2 and subsequently with three butts 6,7 and 8, namely a first butt, a second butt and a third butt, the last mentioned one of which is carried by a tailpiece 35 in which, transversely, there is suddenly a reduced area 35*a*: this allows the said tailpiece to bend (direction H) in the presence of corresponding stress pressing on the third butt 8.

In the support structure of the carriage 1 are provided sets of bushes 9 (eight per set in the case under examination), the axes of the bushes in each set being situated in a plane perpendicular to the directions T1 and T2. Freely inserted in the said bushes are corresponding rods 10 provided with selector elements 11, each of which having two inclined surfaces 11*a* and 11*b*, respectively, that are symmetrical with respect to the said plane.

Each said rod is rendered movable from a non-operative position I to an operative position O, more about which will be said below.

Provision is made beneath the selector elements 11 in each set for a fixed operating cam 12, symmetrical with respect to the vertical plane of simmetry of the said elements 11, so positioned as to define, between the upper end 12*a* thereof and the lowest element 11 in the said set, a longitudinal housing 20 through which, as will be said in the ensuing text, the second butt 7 can pass. In the cam 12 there is a longitudinal race 16 (constituted by a central horizontal section 16*a* and two inclines 16*b*, one for entering and the other for leaving the said central section) positioned in such a way as to intercept the third butt 8 when the blade element 5 is in the neutral position R. The said interception causes the tailpiece 35 to undergo elastic flexure, in the direction H as stated above, in the plane of the corresponding slit 3.

In the cam 12 there is, above the race 16, a cutaway 40, the lower part of which is delimited by a central horizontal section 40*a*, at a right angle, adjacent to and inside with respect to the said horizontal section 16*a*, by two ascendant inclines 40*b* (that fork symmetrically with respect to the central section 40*a*) and, lastly, by two upper horizontal sections 40*c*.

In between a group of selector elements 11 and the one following on, or previous thereto, placed in an inside position with respect to the upper sections 40*c* of two consecutive cams 12, is a set of fixed cams 50 consisting, in the case under examination, of three cams 13, 14 and 15 symmetrical with respect to a plane equidistant from the planes of symmetry of two consecutive groups of selector elements 11.

Each selector element 11 is destined, when in the operative position O, to intercept the first butt 6 of the corresponding blade element 5. In the case described herein, the butt 6 of a blade element is intercepted by the selector element 11 that is the last but one from the bottom.

While in reality the blade element 5 is stationary, the carriage moves in the direction T1 or T2. Since this a question of relative motion between the blade element and the carriage, in FIG. 2 the carriage is supposed to be stationary and the blade element 5 to be moving in the direction T2, which is equivalent to considering the blade element 5 to be stationary and the carriage to be moving in the direction T1.

A description is now given of the operation of the improved machine according to the invention, with particular reference to the two characteristic situations, namely when a blade element is selected or not selected.

Figure 4A:
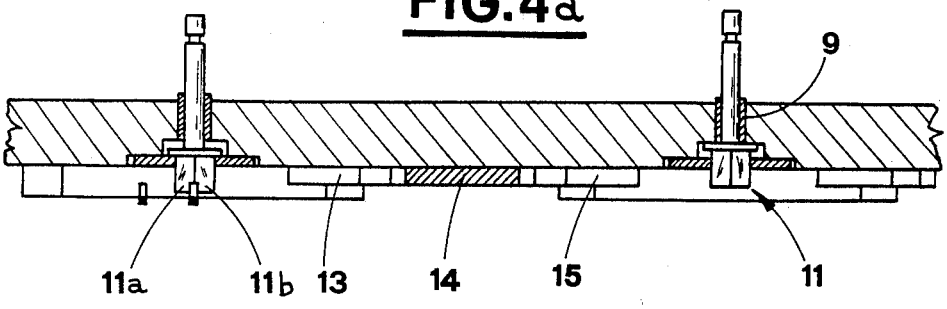

The former situation occurs with the selector element 11 in the non-operative position I (FIG. 4*b*). In this case, the blade element 5 stays in the neutral position R, the butt 7 passes through the longitudinal housing 20, while the interception against the butt 8 of the race 16 causes in the tailpiece, in the order stated, a gradual increase in deflection (ingoing incline 16*b*), constant deflection (central section 16*a*) and, lastly, a gradual decrease in deflection until zeroed (outgoing incline 16*b*).

For the latter situation, the selector element 11 is in the operative position O (FIGS. 5*a* and 5*b*). An examination follows of the various displacements to which the blade element is subjected (with reference to FIGS. 2, 3, 5*a* and 5*b*). The butt is intercepted by the ingoing incline 16*b* of the race 16 and, subsequently, by the central section 16*a* thereof. This causes, as will be recalled, the deflection of the tailpiece 35 towards the inside of the corresponding slit. With the butt 8 intercepted by the initial part of the section 16*a*, the lower part of the butt 6 is intercepted by the surface 11*a* of the selector element 11; this causes the blade element 5 to be raised from the neutral position R to a first intermediate position R1.

Figure 3:
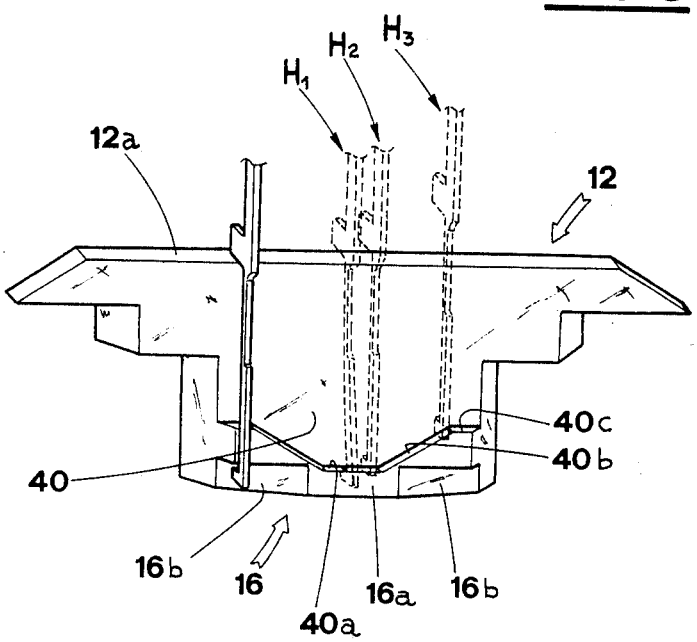
FIG. 3 shows, in a perspective view, a first embodiment for the fixed operating cam that is destined to raise the blade element from the first to the second intermediate position, and also shows, with an unbroken line and in dashes, the most significant positions adopted by a blade element with respect to the said fixed cam.

In consequence of the said elevation, the butt 8 is jerked into insertion in the cutaway 40 (this being facilitated by the elastic pressures of the tailpiece 35 previously subjected to flexure by the ingoing incline 16*b*): this is illustrated in FIG. 3 through the positions H11 and H2 (shown with dashes) of the blade element 5 prior to and after the butt 8 being jerked into insertion in the cutaway 40.

With the blade element in position R1 the interception takes place (because of the movement in direction T1 of the carriage) of the ascendant incline 40*b* against the lower part of the butt 8 (for example position H3 shown with dashes in FIG. 2). This brings about a further elevation of the blade element 5 which is carried into a second intermediate position R2 defined by the said upper horizontal section 40*c*.

The interception of the surface 13*a* of the cam 13 against the lower part of the butt 7 occurs when the blade element is in position R2 (again as a consequence of the movement in direction T1 of the carriage). This causes a further, final, elevation of the blade element 5 from position R2 to position R3 (the maximum raised position) whereby the corresponding needle (with which the blade element 4 is provided) is carried into operation.

Finally, with the movement in the direction T1 of the carriage, the interception takes place of the surfaces 14*a* and 15*a* of the cams 14 and 15, respectively, against the upper part of the butt 7 whereby the blade element 5 is lowered from position R3 down to the said neutral position R.

Since the cams 12,13,14 and 15, and the selector elements 11 are symmetrical with respect to corresponding vertical planes, the same considerations as above apply as regards the movement in the direction T2 of the carriage.

It is stressed that the raising of the blade element from position R1 to position R2 is dependent on the insertion into the cutaway 40 of the butt 8 which, moreover, is aided by the elastic pressure of the tailpiece 35. This is of the utmost importance since, should the elevation (from R to R1) effected by the selector element 11 be below a predetermined value, the butt 8 continues to stay on the race 16, while the blade element is only raised a little from the position R and so the interception of the cam 13 against the butt 7 fails. Subsequently it will be up to the cam 15 to realign the blade element 5 in the neutral position R.

In other words, unsatisfactory action on the butt 6 on the part of the selector element 11 causes solely the needle connected to the selected blade element "not to be sent into operation" without any danger of the breakage of the butts of the said element, this remaining sound and suitable to be selected (eventually) by the group of selector elements 11 that succeds the previous group.

The lower part of the cam 12 is provided, in the second embodiment (FIGS. 6 and 7), with a longitudinal race 53 interrupted centrally by a re-entrant part 54 that is symmetrical with respect to the vertical plane of symmetry of the selector elements 11. The said re-entrant part 54 divides the race into two parts 53*a* and 53*b*, respectively, and these commence with a rectilinear section that joins, without any break in continuity, an upward curved section.

Above the race 53 there is, in the cam 52, a cutaway 55, the lower part of which runs into the re-entrant part 54. The cutaway is delimited laterally by two ascendant inclines 55*a* (that fork symmetrically starting at the re-entrant part 54), and by two upper horizontal parts 55*b*. The surfaces of the said inclines 55*a* and of the said horizontal parts 55*b* are perpendicular to the base 55*c* of the cutaway that is oriented longitudinally. It is stressed that the lower edge 55*d* of the base 55*c* (namely the edge common to the part 54) slopes, as can be seen in FIG. 7.

Apparent, when viewing the cam 52 head-on, are the upper end 52*a* and the base 55*c* of the cutaway 55: the said cutaway defined by two blocks 56 in between which the re-entrant part 54 is formed. The lower longitudinal surface of the said blocks constitutes the said race 53, while in the surfaces of the said blocks are machined the said inclines 55*a* and the said parts 55*b*.

Commencing at the re-entrant part 54, the inner parts of the said blocks 56 are provided with one sloping section 57 per part, each defined by a vertical surface that originates at the said re-entrant part and is transversely of a depth that, proceeding longitudinally towards the outside of the cam, increases. The said sloping sections 57 constitute the initial part of corresponding longitudinal tracks C1, more about which will be said hereinafter.

The operation of the second embodiment of the improved machine will now be described with particular reference to the two characteristic situations, namely when a blade element is selected or not selected, assuming this to be a blade element 5 of the type illustrated in FIG. 1.

The former situation occurs with the selector element 11 in the non-operative position I (FIG. 4*b*.) In this case, the blade element 5 stays in the neutral position R, the butt 7 passes through the longitudinal housing 20, while the butt 8 skims over, in the order stated, the rectilinear sections of the parts 53*a* and 53*b* of the race 53: in the said situation, the tailpiece 35 of the blade element is not subjected to any stress at all.

With the latter situation, the selectior element 11 is in the operative position O (FIGS. 5*a* and 5*b*). An examination follows of the various displacements to which the blade element 5 is subjected (with reference to FIGS. 2, 5*a*, 5*b* and 6). The selector element 11 is carried into the operative position O when the blade element 5 in question is located in the region of the re-entrant part 54, and it thus ensues that the butt 8 skims over the rectilinear section of the part 53*a* situated upstream of the re-entrant part 54, with respect to the movement direction of the carriage, prior to being positioned therein (position P1 in FIG. 6).

The interception of the surface 11*a* of the selector element 11 against the lower part of the butt 6 causes the blade element 5 to be raised from the neutral position R (FIG. 5*a*) to a first intermediate position R1 (FIG. 5*b*); the said position is shown at P2 in FIG. 6.

The said elevation (in no way obstructed by the base 55*c* of the cutaway 55 but aided by the lower edge 55*d* of the said base) carries the butt 8 into the inside of the cutaway 55 without any stress applied to the tailpiece 35.

With the blade element in position R1, the interception takes place (because of the carriage moving in direction T1) of the ascendant incline 55*a* against the lower part of the butt 8 (for example, the position F3 shown with dashes in FIG. 6). This brings about a further elevation of the blade element 5 whereby this is carried into a second intermediate position R2 defined by the said upper horizontal part 55*b*.

The interception then occurs, with the blade element in position R2, (again in consequence of the movement of the carriage in the direction T1), of the surface 13*a* of the cam 13 against the lower part of the butt 7. This causes a further, and a final, elevation of the blade element 5 from position R2 to position R3 (the maximum raised position) whereby the relevant needle (provided in the blade element 4) is carried into operation.

Then with the carriage still moving in the direction T1, the interception takes place of the surfaces 14*a* and 15*a* of the cams 14 and 15, respectively, against the upper part of the butt 7. This causes the blade element 5 to be lowered from position R3 down to the said neutral position R.

In the event of the elevation of the blade element 5 brought about by the interception of the selector element 11 against the butt 6 not being sufficient to cause the subsequent interception of the incline 55*a* against the lower part of the butt 8, thanks to the particular conformation of the cam 12, the said butt is not subjected to breakage. The front surface of the butt 8 is, in fact, intercepted, in the situation to which reference has just been made (position K1 in FIG. 7), by the sloping section 57 and this results in a consequent gradual elastic flexure of the tailpiece 35 (the said deflection being made possible by the suddenly reduced area 35*a*). Because the butt is intercepted by the track C1 of the block 56 (position K2 in FIG. 7), the deflection continues: the curved section of the part 53*a* of the successive cam 12 then has the task of re-aligning the blade element 5 in the neutral position R.

When use made of the blade element 5 depicted in FIG. 1*a*, instead of undergoing flexure, the tailpiece 35 oscillates with respect to the axis thereof, in contrast with the corresponding spring 60.

The cams 12,13,14 and 15 the selector elements 11 are symmetrical with respect to corresponding vertical planes, and thus the same considerations as above apply also to the movement in the direction T2 of the carriage.

To conclude, the particular conformation of the blade element 5 and of the cam 12 depicted in FIGS. 6 and 7 enables the under mentioned advantages to be obtained:

- the blade element 5 is not subjected to any stress in the event of the non-selection thereof;
- the blade element 5 is not subjected to any stress when selected correctly: in fact the cam 12 attends to raising the element in question from the first to the second intermediate position;
- the blade element 5 undergoes stress or oscillates should, in the embodiments depicted in FIGS. 1 and 1*a*, the selector element 11 operate unsatisfactorily: this merely involves the needle connected to the blade element selected "not being sent into operation", without any danger of breakage to the butts of the said blade element, this continuing to be sound and suitable to be selected (eventually) by the group of selector elements 11 that succeeds the previous group.

An advantage in both embodiments is obtained in consequence of one single selector element being used instead of two as in conventional solutions.

Both blade elements depicted in FIG. 1 and are provided also with the upper butt 2 that is rested against a corresponding fixed cam 30 (shown with dashes in FIG. 2 and placed above the selector elements 11) during the elevation of the blade element concerned from position R1 to position R2.

It is understood that the foregoing description has been gieven purely as an unlimited example and thus that any variants in the above technical solution in no way prejudice the framework of protection afforded to the invention as claimed hereinafter.

I claim:

1. Improved automatic straight knitting machine, of the type comprising, among other things, at least one flat longitudinal needle bed provided with transverse equidistantly made slits, in each of which is inserted, commencing at the top and working downwards, a needle with the corresponding blade element, the latter provided with at least two butts, namely a first butt and a second butt, that project from the front side of the needle bed, a carriage being connected to this, able to reciprocate longitudinally, in turn comprising: firstly, selector elements, symmetrical with respect to a vertical transverse plane and movable between two positions, that is to say, a non-operative position and an operative position, the latter for intercepting the first butt of a corresponding blade element, with the consequent raising of this from a neutral position to a first intermediate position; secondly, means destined to raise the said blade element from the first intermediate position to a second intermediate position; thirdly, means for intercepting the said second butt in order, first of all, to raise the said blade element from the second intermediate position to a maximum elevated position, with the corresponding needle sent into operation, and then to lower the said blade element down to the said neutral position; wherein the said means for raising the said blade element from the first intermediate position to the second intermediate position comprise, on each blade element, a third butt oriented in like fashion to the butts, positioned beneath the second butt and connected thereto through a tailpiece restrained to elastic means such as permit the said tailpiece to undergo oscillantions over the transverse plane of the slit in which the said blade element is received; the said raising means also comprising an operating cam, integral with the carriage, that exerts an effect on the said third butt in order to uplift the corresponding blade element from the said first intermediate position to the said second intermediate position solely when the said blade element is in the said first position, or in order to guide the said third butt, and thus the corresponding blade element, into the said neutral position or into a position in between this and the first intermediate position.

2. Machine according to claim 1, wherein the said operating cam comprises: a longitudinal race for intercepting, sliding there over, the said third butt solely when the said blade element is in the neutral position, with consequent deflection of the corresponding tailpiece towards the inside of the slit; a cutaway, adjacent to the said race and there above, destined to receive in jerks the said third butt as a consequence of the raising of the said blade element from the neutral position towards the first intermediate position; and means for intercepting the said third butt solely when this is in the said cutaway, in order to raise the said blade element from the first intermediate position to the second intermediate position.

3. Machine according to claim 1, wherein the said operating cam comprises: a longitudinal race, interrupted centrally by a re-entrant part that is symmetrical with respect to the plane of symmetry of the said selector elements, with the part of the said race situated upstream of the re-entrant part, with respect to the direction in which the carriage moves, in order to intercept the said third butt so as to define the neutral position for each blade element, and with the other part of the said race situated downstream of the said re-entrant part in order to guide, solely when the blade element concerned is kept in the neutral position downstream of the said re-entrant part, the said third butt; a cutaway, the lower part of which runs into the said re-entrant part, destined to receive the said third butt as a consequence of the raising of the said blade element from the neutral position to the first intermediate position; first means for intercepting the third butt solely when this is in the said cutaway, in order to raise the said blade element from the first intermediate position to the second intermediate position; and second means for intercepting the said third butt as a consequence of the raising of the blade element from the corresponding neutral position and, in the absence of interception of the said third butt on the part of the said first means interception, the interception of the said second means against the said third butt, causing the tailpiece in respect of the said third butt to oscillate, in contrast with the elastic means connected thereto.

4. Machine according to claim 2, wherein the said means for intercepting the third butt are constituted by two identical races that extend symmetrically with respect to a vertical transverse plane, one delimiting upstream the said cutaway, and the other delimiting this downstream, each race being constituted by a sloping section, the area of which increases from the bottom upwards, and by a horizontal longitudinal section destined to raise the said blade element from the first intermediate position to the second intermediate position, and to define the latter position, respectively.

5. Machine according to claim 2, wherein the said longitudinal race is constituted by a central section, spaced constantly with respect to the front of the needle bed, and by two inclines adjacent to the central section, the spacing of which, starting at the said central section and going towards the outside, increases with respect to the said front of the needle bed.

6. Machine according to claim 2 or 3, wherein the said blade element is provided a further butt that is envisaged to rest, during the raising of the blade element concerned from the first to the second intermediate position, against a cam integral with the carriage.

7. Machine according to claim 3, wherein the said first means for intercepting the third butt are constituted by two identical races that extend symmetrically with respect to the said vertical transverse plane, one delimiting upstream the said cutaway, and the other delimiting this downstream, each race being constituted by an incline, the area of which increases from the bottom upwards, and by a horizontal longitudinal part destined to raise the said blade element from the first to the second intermediate position, and to define the latter position, respectively; wherein the said second means for intercepting the third butt are constituted by two identical tracks that extend longitudnally and symmetrically with respect to the said vertical transverse plane, each originating in the region of the said re-entrant part with a sloping section that is defined by a vertical surface of a transverse depth that increases lengthwise towards the outside of the said cam, and is made at a point corresponding to the apex between the said sloping part of the race of the first means of interception and the said longitudinal race, following which provision is made for a longitudinal section of a transverse depth that is constant.

8. Machine according to claim 3, wherein the longitudinal edge of the said re-entrant part, common to the said cutaway, slopes at a transverse depth that increases from the bottom upwards.

9. Machine according to claim 3, wherein each of the two parts that constitute the said longitudinal race has, starting at the said re-entrant part, a horizontal section that joins, without any break in continuity, an upward curved section.

10. Machine according to claim 2 or 3 wherein the said elastic means are defined by a reduced area made in the said tailpiece.

11. Machine according to claim 2 or 3, wherein the said elastic means are constituted by at least one spring that exerts an effect on the said tailpiece and is inserted in the housing provided therein.

* * * * *